United States Patent [19]

Snook

[11] Patent Number: 4,567,700

[45] Date of Patent: Feb. 4, 1986

[54] FRAME-SUPPORTED MEMBRANE FOR CHIMNEY

[75] Inventor: Randolph W. Snook, Pittsburgh, Pa.

[73] Assignee: Rust Chimney Incorporated, Pittsburgh, Pa.

[21] Appl. No.: 478,308

[22] Filed: Mar. 24, 1983

Related U.S. Application Data

[63] Continuation-in-part of Ser. No. 478,309, Mar. 24, 1983.

[51] Int. Cl.[4] ..... E04H 12/28

[52] U.S. Cl. ..... 52/219; 98/58; 110/184; 52/218; 52/247; 52/248

[58] Field of Search ..... 52/218, 245, 219, 247, 52/248; 110/184; 98/58, 60; 211/182; 114/187

[56] References Cited

U.S. PATENT DOCUMENTS

| | | | |
|---|---|---|---|
| 3,522,767 | 8/1970 | Derringer | 110/184 X |
| 3,669,042 | 6/1972 | Lawrence | 110/184 |
| 3,782,266 | 1/1974 | Snook | 98/58 |
| 4,265,166 | 5/1981 | Parker et al. | 110/184 X |

FOREIGN PATENT DOCUMENTS

| | | | |
|---|---|---|---|
| 1227632 | 10/1966 | Fed. Rep. of Germany | 98/58 |
| 2264349 | 7/1973 | Fed. Rep. of Germany | 52/219 |

*Primary Examiner*—Carl D. Friedman
*Assistant Examiner*—Naoko N. Slack
*Attorney, Agent, or Firm*—Cushman, Darby & Cushman

[57] ABSTRACT

In its preferred embodiment, the improved frame-supported membrane has a membrane of light-gauge, corrosion resistant nickel alloy construction, this membrane being suspended within a base-supported frame. The membrane-to-frame hanger is designed for easy installation and provides for radial expansion of the membrane relative to the frame, yet restrains the membrane against implosive force and earthquake shear. For some installations, the improved frame-supported membrane may constitute the chimney without need for there being further provided a circumferentially surrounding masonry chimney column. In any event such a masonry chimney column if provided may serve primarily merely as a wind shield for the improved frame-supported membrane.

11 Claims, 13 Drawing Figures

FRAME-SUPPORTED MEMBRANE FOR CHIMNEY

REFERENCE TO RELATED APPLICATION

This is a continuation-in-part of my copending application Ser. No. 478,309, filed on even date herewith and entitled Chimney Lining System Including Frame-Supported Membrane.

BACKGROUND OF THE INVENTION

In the art of industrial chimney manufacture, the use of alloy materials to resist corrosion has become more acceptable in recent years, in spite of the relatively high costs associated with such materials.

For the past several years, electric utilities and other industries in the U.S. have been required by law to reduce the amount of sulfur dioxide and other recognized pollutants emitted by their activities. One method to capture sulfur dioxide is the use of wet lime or limestone scrubbers. However, the use of these systems produces a wider range of chimney operating conditions ranging from low temperature, highly acidic, to alkaline at high temperatures. Alloy materials such as alloy 625 and some stainless steels have been recognized as providing superior corrosion resistance to the broad spectrum of operation encountered downstream of FGD systems. However, the cost of alloy materials is prohibitive.

The present inventor is a joint inventor named in the U.S. patent of Parker et al 4,265,166, issued May 5, 1981, which patent relates to a chimney lining system which can utilize the superior corrosion resistance of alloy steels in scrubbed flue gas environment without using a heavy, very expensive alloy plate. The Parker et al system is particularly directed toward retrofit projects where the membrane would be installed within an existing steel lining. The system requires the use of flexible suspenders which permit radial expansion and uses horizontal corrugations for axial expansion. The resulting annulus between the membrane and the steel lining is subject to a partial vacuum pressure to enable the membrane to resist negative pressure and potential implosions within the chimney. Considered in the wider realm of industrial chimney manufacture, use and maintenance, the Parker et al system can be seen to possess certain disadvantages or shortcomings, including:

(a) The horizontal corrugation providing axial expansion protrudes into the gas stream and, as a consequence, is subject to erosion.

(b) The use of a partial vacuum pressure to resist negative pressure and implosions facilitates entry of contaminants into the annulus which will accelerate corrosion if cracks or holes occur. The vacuum pressure may also require additional stiffening on the exterior of the existing lining.

(c) Once installed, the membrane cannot be serviced or inspected since it is hidden by the presence of the existing steel liner.

(d) The system is not readily adaptable to new construction.

In my aforementioned copending parent patent application I have disclosed a chimney lining system in which a membrane, typically 60 mils thick, of corrosion-resistant alloy material is suspended within an external skeletal framework of less-expensive carbon steel. Hangers provide for radial expansion of the liner. However, inward movement of the hangers is restrained.

Axially spaced circumferential corrugations located midway axially between where two membrane sections are stiffened, joined and connected to the framework, provide for axial expansion. The external framework is disposed within a tubular concrete chimney column. At several levels, grillages support the external framework from the wall of the chimney column. The structural grillages may bear upon load cells equipped to signal the build-up of sludge on the interior of the liner.

The entire disclosure of the parent application is hereby incorporated herein.

SUMMARY OF THE INVENTION

In its preferred embodiment, the improved frame-supported membrane has a membrane of light-gauge, corrosion resistant nickel alloy construction, this membrane being suspended within a base-supported frame. The membrane-to-frame hanger is designed for easy installation and provides for radial expansion of the membrane relative to the frame, yet restrains the membrane against implosive force and earthquake shear. For some installations, the improved frame-supported membrane may constitute the chimney without need for there being further provided a circumferentially surrounding masonry chimney column. In any event such a masonry chimney column if provided may serve primarily merely as a wind shield for the improved frame-supported membrane.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1A:
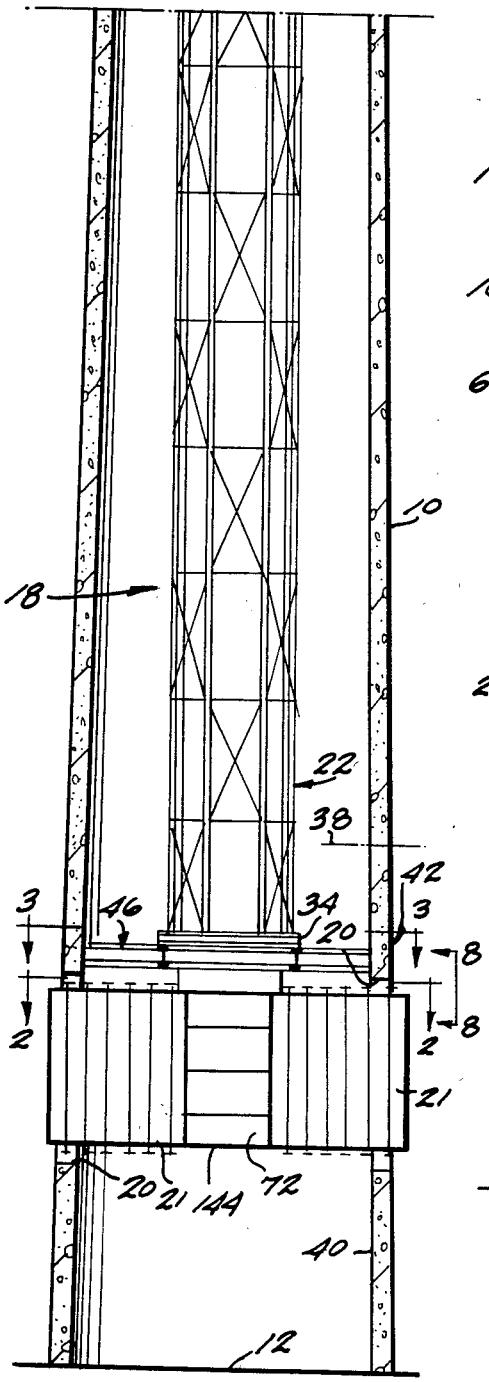
FIGS. 1A, 1B and 1C respectively are lower middle and upper complementary portions of a relatively small scale side elevation view of an improved frame-supported membrane chimney structure embodying principles of the present invention.
Figure 1B:
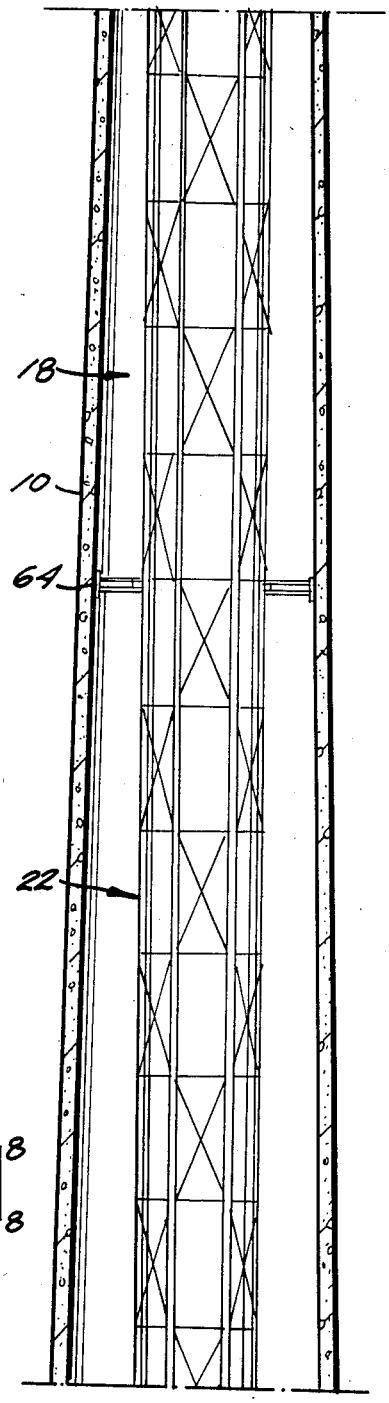
Figure 1C:
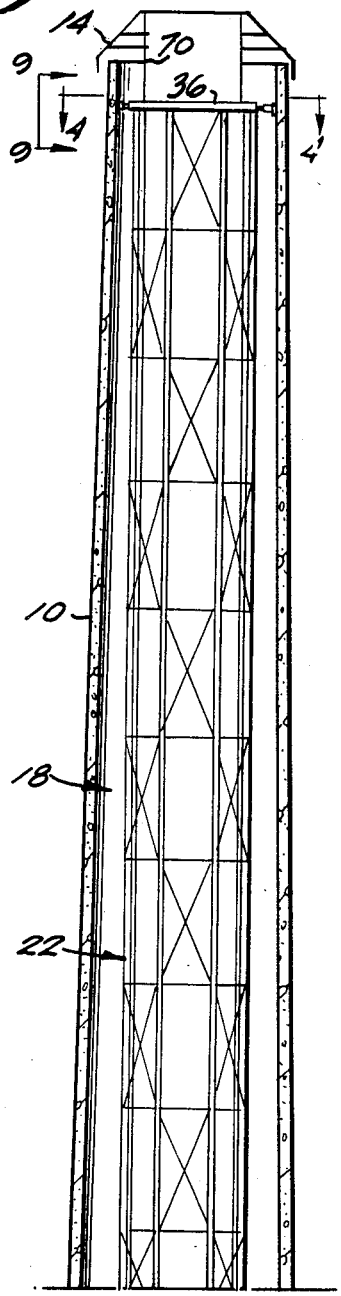
Figure 2:
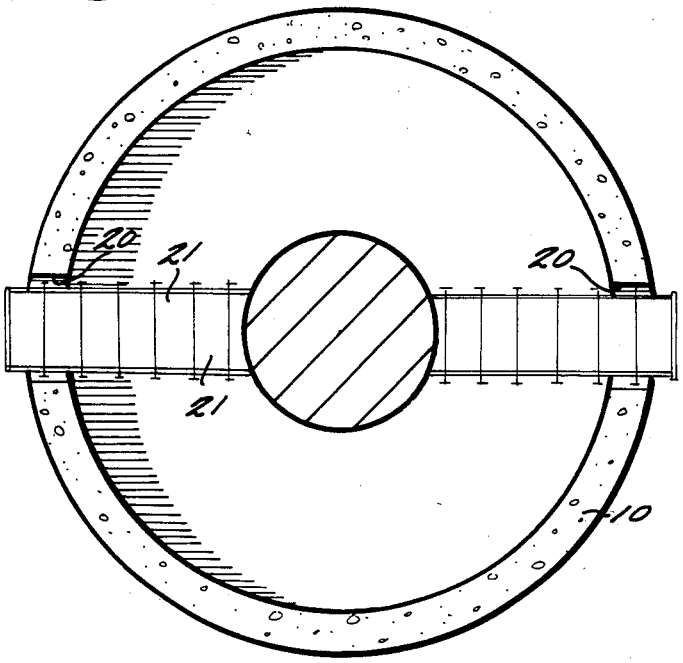
FIG. 2 is an intermediate scale transverse sectional view thereof the breeching inlets, on line 2—2 of FIG. 1A.
Figure 9:
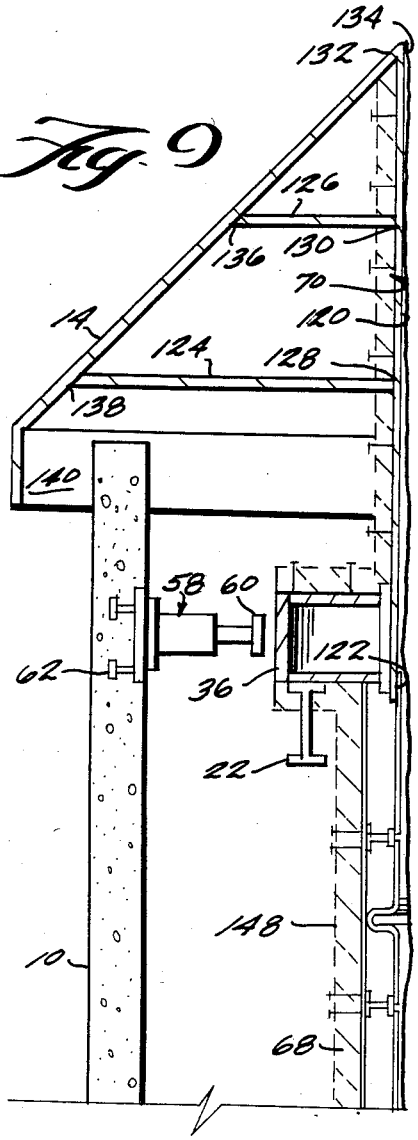
FIG. 9 is a said larger scale fragmentary longitudinal sectional view on line 9—9 of FIG. 1C, showing the upper end portion of the improved frame supported membrane chimney structure.

A typical tubular modern industrial chimney column cast in place of concrete is shown at 10 in FIGS. 1A–1C. Typically, from the top of the foundation at 12 to the top of the rainhood 14, the chimney measures eight hundred feet in height, is sixty-eight and two-thirds feet in outside diameter at the base and tapers to twenty-seven feet in outside diameter at the top. The rainhood typically is thirty and two-thirds feet in major diameter. (The rainhood is mounted to the membrane 16 of the frame-supported membrane structure 18, as illustrated in FIG. 9.)

In many installations, the masonry chimney column 10 may be dispensed with, so that the improved frame-supported membrane structure 18 constitutes the chimney. In any event, the masonry chimney 10, if provided, preferably serves primarily as a wind shield for the frame-supported membrane structure 18.

If used, as shown, the typical chimney column 10 is distinguished a relatively short distance above the foundation 12, by two diametrically opposed generally rectangular openings 20 for breeching 21, e.g. beginning at the thirty-nine foot level. The breeching typically is eight feet wide by twenty-three feet high.

The frame 22 of the frame-supported membrane structure 18 preferably is a tubular, largely open framework, typically fabricated of box-channel vertical legs 24 and horizontal members 26. The X-crossed pairs of bracing strut members 28 may each be constituted by pairs of L-channels secured together back-to-back to form T-shaped elements. Connections at 30 where the ends of a horizontal member connect between two angularly neighboring legs 24 preferably is accomplished by welding, as are the connections at 32, where diagonal struts 28 intersect corners of every other bay of the reticular network provided by the legs 24 and horizontal members 26. Other or augmented forms of connection may be employed.

Figure 8:
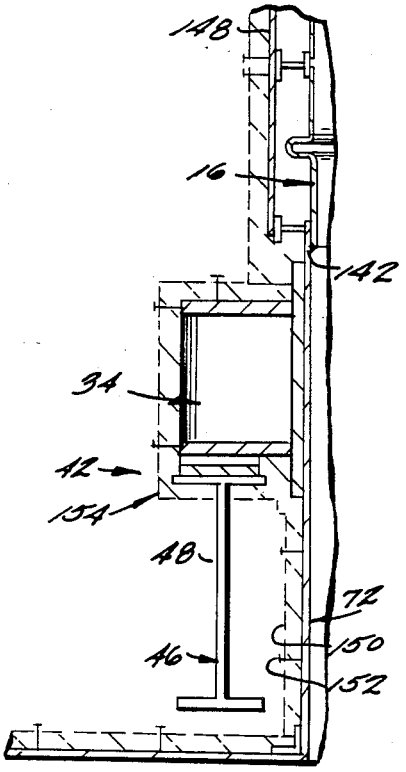
FIG. 8 is a said larger scale fragmentary longitudinal sectional view on line 8—8 of FIG. 1A showing breeching entry to the flue of the membrane.

A lower ring girder 34 is shown in FIGS. 1A and 8 provided and connected on the frame 22 as the lower end element thereof. Likewise an upper ring girder 36 is shown in FIGS. 1C and 9 provided and connected on the frame 22 as the upper end element thereof.

Typically, the distance between levels of horizontal members 26 is ten feet and there are eight vertical legs 24 spaced forty-five degrees apart around the circumference of the frame 22. Characteristically, the framework 22 is very open.

Where the structure includes a masonry chimney column 10, the framework preferably extends from just above the breeching openings 20 to about two feet below the upper end of the masonry chimney column 10. When the masonry chimney column 10 is omitted as unnecessary, the framework 20 may be extended down to the foundation 12 with two suitably modified and braced bays for admitting the breeching 21. As an alternative when the masonry chimney column 10 is to be omitted, yet its base portion up to the level 38 may be provided as a frame-to-foundation support structure, and for admitting the breeching.

Where the masonry chimney column 10 or at least its base 40 is provided the weight of the frame supported membrane is transferred to the foundation 12 via support means on the base 40 at 42 at a level typically located immediately above the breeching openings 20.

Figure 3:
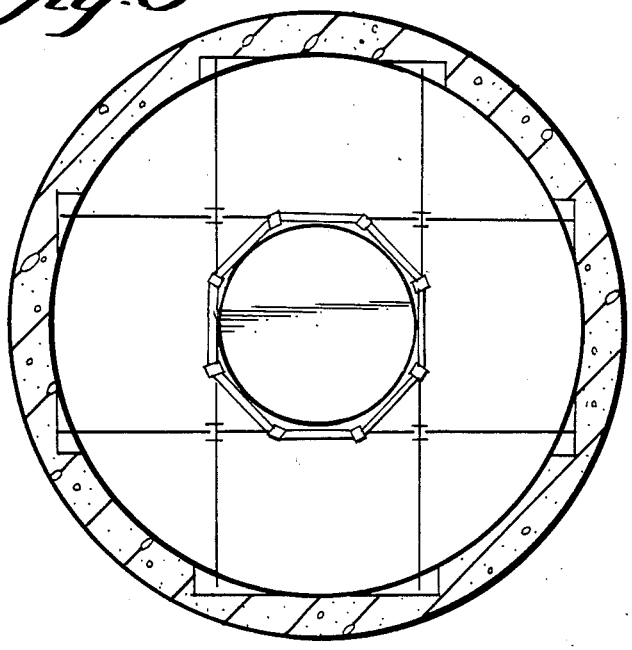
FIG. 3 is an intermediate scale transverse sectional view of the improved frame supported membrane chimney structure showing the main support grillage, on line 3—3 of FIG. 1A.

As shown in FIGS. 1A, 3 and 8, at the level where the frame 22 is to be mounted on the base 40, the base is internally provided at eight locations equiangularly spaced about the circumference of the base with respective molded-in notches 44 of generally triangular top plan figure. A tic-tac-toe grid-shaped grillage structure 46 of respective I-beam members 48 having moment connections 50 at each of the four intermediate sites where they cross. The eight ends 52 of the four grillage beams 48 laterally enter the respective notches 44 and rest upon the respective upwardly presented shoulders 54 therein. As shown best in FIG. 8, the lower ring girder 34 of the frame 22 rests on the four upper flanges 56 of the center cell of the grillage 48.

Figure 4:
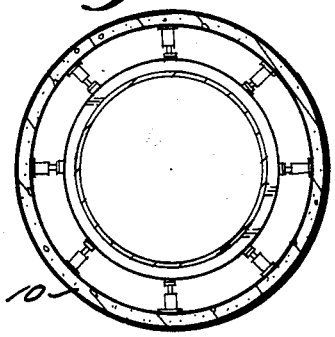
FIG. 4 is an intermediate scale transverse sectional view thereof on line 4—4 of FIG. 1C showing a typical set of bumpers provided between the structural frame and the masonry chimney column slightly below the upper end of the latter.
Figure 5:
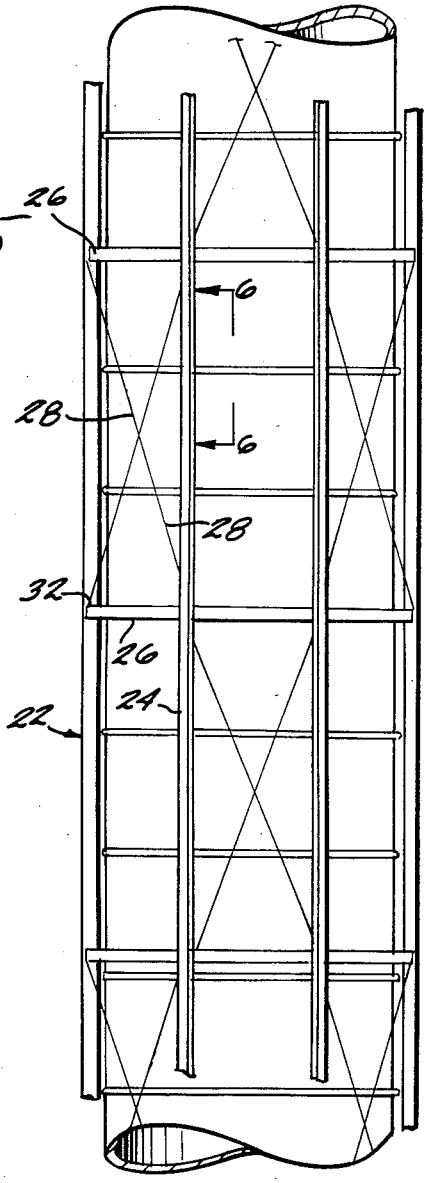
FIG. 5 is an intermediate scale fragmentary side elevation view of the improved frame-supported membrane, corresponding to the upper portion of FIG. 1A, minus the masonry chimney column and insulation which may be provided.

As shown in FIGS. 1C, 4 and 9, radially surrounding the upper ring girder 36 near the upper end of the masonry chimney column 10, the latter may be internally provided at a plurality of radially inwardly directed shock absorber-type bumpers 58 having their plungers 60 projected radially inwardly to close proximity with the upper ring girder 36. There are eight equiangularly spaced bumpers 58 shown. Their radial dispositions are such as to permit a very small amount of lateral motion of the upper end of the frame 22 relative to the masonry chimney column 10, whereupon increasing resistance building-up to a positive stop is provided by the respective particularly impacted bumpers 58. The bumpers 8 are shown mounted to the masonry chimney column at their respective bases by bolts 62 embedded in the concrete.

If necessary or desired, additional lateral bracing may be similarly provided at one or more intermediate levels, such as is illustrated at 64 in FIG. 1B.

What remains for description is the membrane 16, the membrane-to-frame hanger assemblies 66, thermal insulation 68 for the exterior of the membrane 16, the top membrane section 70 including the rainhood 14, and the bottom membrane section 72 including the breeching 21.

The membrane 16 is shown in FIGS. 6-11 being a fabricated right cylindrical tubular structure made of pre-formed corrosion resistant alloy sheets 74 in a plurality of vertically adjacent courses. Typically each course is slightly shorter than two feet high, and within each course the vertically extending angularly adjoining sheet ends are welded together along vertically extending seam lines, the seams preferably being maximally out of vertical registry from course to course. Where two courses of sheets 74 are in vertically neighboring relation, they are interconnected by plating the exterior of a slight vertical gap 76 with the radially inner flange 78 of a hooped-shaped, I-sectioned back-up bar 80. The upper edge of the lower course of sheets and the lower edge of the upper course of sheets are circumferentially welded to the respective back-up bar 80 inner flange 78 from within the flue of the membrane 16.

In order to accommodate membrane expansion, in certain of the courses, e.g. every fourth course, the sheets 74 are collectively provided with an externally bulged circumferential corrugation 82.

Figure 7:
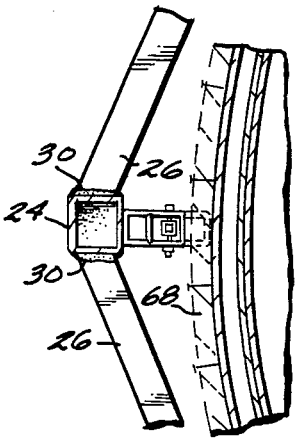
FIG. 7 is a said larger scale fragmentary transverse sectional view on line 7—7 of FIG. 6.
Figure 6:
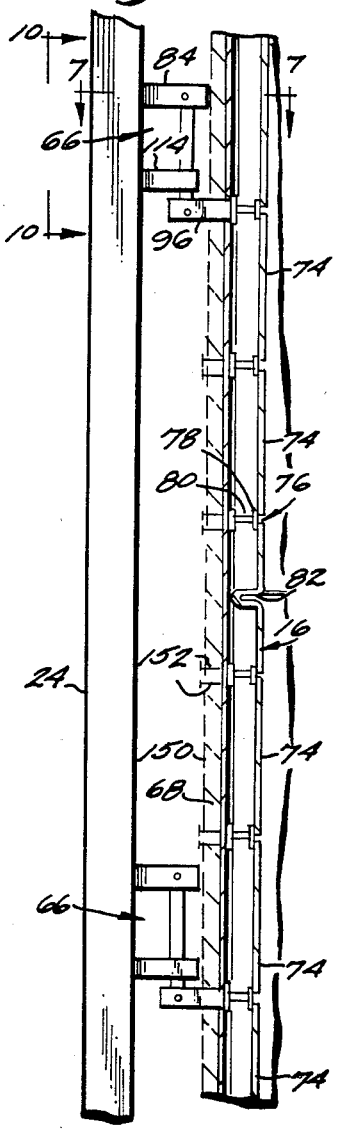
FIG. 6 is a larger scale fragmentary longitudinal sectional view on line 6—6 of FIG. 5 showing typical membrane-to-frame supports.
Figure 10:
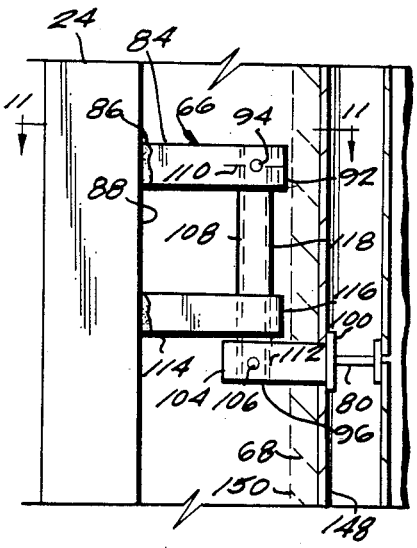
FIG. 10 is a said larger scale fragmentary longitudinal sectional view on line 10—10 of FIG. 6, showing a typical membrane-to-frame hanger assembly.
Figure 11:
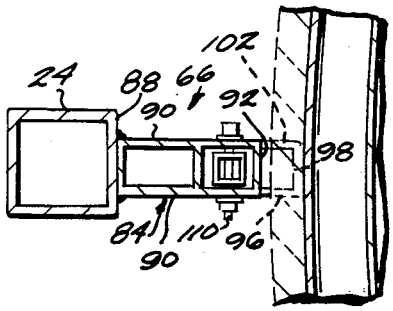
FIG. 11 is a said larger scale fragmentary transverse sectional view on line 11—11 of FIG. 10.

Two vertically neighboring ones of the membrane-to-frame hanger assemblies 66 are shown in FIG. 6; one of these is shown in top plan in FIG. 7. In FIG. 10 one of the hanger assemblies 66 is shown in side elevation on a larger scale, and in FIG. 11 it is shown in transverse cross-sectional view.

In general, each hanger assembly 66 includes an upper bracket 84 welded at its radially outermost base 86 onto the radially inner face 88 of a respective leg 24 of the structural frame 22. This rigid bracket 84 is of axially short generally rectangular tubular shape, so that it has two opposite sidewalls 90 which extend radially inwardly from the base 86, and a radially innermost end wall 92. The bracket 84 is designed to be field installed by welding at 86/88 and preferably is made to be about as long as it can be in the radial direction without interfering with the insulation 68 which may be provided on the outside of the membrane 16. Approximately two-thirds of the distance across the gap between the leg 24 and the back-up bar 80, the bracket 84 is provided with a transverse, horizontal axis pair of openings 94 through the sidewalls 90.

The hanger assembly 66 further includes a lower bracket 96 welded at its radially innermost base 98 onto the radially outer flange 100 of a respective back-up bar 80. This rigid bracket 96 also is of axially short generally rectangular tubular shape, so that it has two opposite sidewalls 102 which extend radially outwardly from the base 98, and a radially outermost end wall 104. The bracket 96 is designed to be field installed by welding at 98/100 and preferably is made to be about half as long in the radial direction as the distance across the gap between the back-up bar 80 and the frame leg 24. Approximately forty percent of the distance across that gap from the backup bar 80, the bracket 96 is provided with a transverse, horizontal axis pair of openings 106 through the sidewalls 102.

The hanger assembly 66 also includes a hanger 108 shown having the form of a square-sectioned tube which is generally vertically oriented and provided with an upper and a lower set of holes on respective horizontal, transverse axes respectively corresponding to the openings 94 and 106 in the frame-connected and membrane back-up bar connected brackets 84, 96. The hanger 108 is narrow enough to snuggly fit between the sidewalls of the respective brackets 84, 96. Then, with the respective openings aligned at 94 and 106, respective nut and bolt assemblies 110, 112 are installed to pivotally interconnect the hanger 108 between the two brackets 84, 96.

The remaining element of the hanger assembly 66 is the hanger restraint member 114. It is shaped much like the bracket 84, and assembled about the hanger 108 between the brackets 84 and 96 before the bolt assemblies 110, 112 are installed, e.g. the hanger restraint member 114 is first field welded to the leg 24 and then as the hanger 108 is slipped into place it is simply also inserted through the restraint member 114. Preferably the restraint member 114 is located below half-way between the brackets 84 and 96. As illustrated, although the relation of the pivots 110, 112 relative to the end walls 92, 104 of the brackets 84, 96 is such as to permit radially outward movement of the hung membrane 16 relative to the frame, the hanger restraint member 114 is slightly radially shorter than the bracket 84, so that its radially inner wall 116 abuts the radially inner side 118 of the hanger 108 at ambient temperature. Accordingly, whereas the hanger restraint member 114 will permit radial expansion of the membrane 16, radial contraction (implosive tendency) of the membrane is prohibited, as is any appreciable lateral or angular movement of the membrane 16 relative to the frame 22.

Preferably, and as shown, the membrane 16 is provided with a top section 70 and a bottom section 72 of somewhat different construction, principally in that these axially short sections, which may lie axially beyond the respective ends of the structural frame 22 are made of thicker, self-braced material. For instance, the top section 70 is shown including a tubular body 120 the lower margin 122 of which is lap welded to the upper margin of the main section of the membrane 16. The upper ring girder 36 is welded to the outside lower marginal portion of the body 120. Spaced above the ring girder 36, respectively about half-way and about three-quarters of the way up the body 120, two annular flanges 124, 126 are welded at their respective inner peripheral edges 128, 130 to the body 120. The lower flange 124 is of substantially greater outer diameter than the upper flange 126, in order that a frustoconical rain hood 14 may be welded perimetrically of its upper end 132 to the upper end 134 of the body 120, to the outer peripheral edge 136 of the upper flange 126 and to the outer peripheral edge 138 of the lower flange 124. The radial extent of the rain hood 14 preferably is such that, where there is provided a concrete chimney column 10, the depending perimetrical skirt 140 of the rain hood 14 spacedly shrouds the upper end of the concrete chimney column.

The bottom section 72 as shown in FIGS. 1A and 8 has its upper marginal edge portion 142 perimetrically lapwelded to the lower margin of the main portion of the membrane 16. The breeching 21 may be made of generally the same material as and form an intersection with the bottom section 72. The lower end 144 may be closed by a plate of the same material fabricated to the body of the bottom section 72. As needed, stiffening and bracing ribs 146 may be secured on the bottom section 72 and/or on the breeching 21.

The structure depicted in the drawings is shown completed by the provision of thermal insulation 68, which may not be necessary in every installation. In the instance depicted, the insulation 68 (which is simply omitted from being shown in the smaller scale views), may be constituted by an external wrap or covering upon the membrane 16 and the breeching 21. This layer preferably is mostly field-applied, after the frame-supported membrane structure 18 is substantially completely assembled. A way that the insulation may be held in place is illustrated in FIGS. 6–11, in which elements 148 are angularly spaced vertically oriented metal laths welded or otherwise secured onto the exterior of the back-up bars 80. The insulation 68 which may be provided in sections or applied as an integral body is preferably placed externally against the laths where such are provided, or externally against the wall to be protected, and covered by wire mesh 150, which is pinned as at 152 for attachment. Accordingly, the pinned mesh 150 prevents the insulation from easily breaking or coming loose in discrete pieces from where it has been placed.

It should be apparent that there has been described hereinabove a novel chimney-lining system, and a novel stand-alone frame supported membrane structure which may be used without a masonry chimney column, which makes efficient use of the relatively expensive construction material, the comparatively light-gauge corrosion resistant nickel alloy material of which the membrane 16 is fabricated.

The use of nickel alloys to resist corrosion of scrubbed flue gases has gained acceptance in the last several years in spite of their relatively high cost. Inconel Alloy 625 has proven to be particularly effective in the most corrosive of environments.

The frame supported membrane 16 may be made of Alloy 625 approximately 60 mils thick supported by an external carbon steel frame 22, e.g. made of A.S.T.M. A36. Axial expansion of the membrane is taken in the formed horizontal corrugations, the spacing of which is determined by the designed temperature range of the flue gases. The membrane 16 is secured to the frame 22 at regular intervals by pinned hangers 108 located vertically intermediate the corrugations. Radial expansion is taken by movement in the hangers which can readily pivotally deflect in an outward direction. However, inward movement of the hangers is restrained by the restraints 114.

Resistance to local circumferential buckling is provided by external carbon steel stiffening rings 80. These, when spaced as shown in the drawing figures may, for instance provide buckling resistance to 20 inches of water. The stiffening rings also provide a frame for securing the external thermal insulation, the use of which is recommended if gas temperatures in the stack are expected to exceed 160° F. for extended periods. Additional buckling resistance is provided by the external structural frame 22.

Field welding of the horizontal joints of the membrane 16 is facilitated by spacing the ring stiffeners 80 to match the rolled width of Alloy 625. Alloy 625 bars shown are used on all horizontal welds as back-up and to prevent contamination when welding the carbon steel stiffeners. The vertical joints of the membrane courses may be butt welded and should be field tested for quality and leakage.

The hood 14, the breeching ducts 21 and the top and bottom sections of the liner may be fabricated of 3/16 inch thick Alloy 625 plate stiffened externally.

FIGS. 1A, 1B and 1C, 2, 3, 4 and 9 particularly show a typical arrangement for a base supported frame. The frame 22 may be laterally restrained at the top and at the other locations as determined by specific design considerations, e.g. by bumpers 58 as described.

When base-supported, the structural frame may bear on conventional load cells e.g. located at 154 which can be used to monitor the weight of the lining system. (Sludge has been found to build up on the interior of ducts and chimney linings downstream from wet scrubbers.)

The frame supported membrane structure 18 can also be designed as a free-standing stack without the use of an exterior concrete windshield 10. Guying or other bracing may be provided as necessary.

Advantages of the frame supported membrane structure of the invention include superior resistance to corrosion. Alloy 625 has been demonstrated to be very effective over a broad spectrum of corrosive conditions. Also, there are fewer temperature restrictions, since the frame supported membrane structure of the preferred embodiment is preferably designed to handle steady state or short term temperatures up to 750° F. Expansion due to differential temperatures is readily accommodated in the frequent corrugations. Rapid gas temperature swings present no problems. A quency system generally is not required. Operating costs are low, because no pressurization or vacuum system is required. The system of the invention can be designed to handle earthquake, or wind forces of virtually any magnitude. Since the frame supported membrane structure 18 is relatively lightweight (compared to brick), it can readily be retro-fitted in an existing chimney, or it may be used with new construction. Further, the frame supported membrane structure of the invention is believed to have all of the advantages and viability of an insulated steel lining while incorporating a material capable of resisting a wide spectrum of corrosive and temperature environments.

In the past, cost has been a prohibitive factor in the use of high nickel alloy for tall chimney liners. The frame supported membrane structure of the invention is believed to be unique in that the material of construction used to contain and convey the corrosive effluent is separate and independent from the structural support system, yet supported at the base.

Providing further details, solely by way of exemplification of the preferred embodiment, the vertical distance between the bottom of the lower ring girder 34 and the first expansion-accommodating corrugation of the membrane 16 may be four feet, the courses of the membrane may be two feet in height from center to center of neighboring back-up bars 80. The corrugations may be provided on eight-foot centers with hangers 66 on each leg about every ten feet. Typically, a one-fourth inch clearance is provided on each hanger assembly between its lower bracket and the associated restraint member. The thermal insulation 68 typically is two inches thick. However, to reemphasize, the proportions and measurements given herein as examples may be scaled up and down and changed in proportion to suit various design criteria that will be apparent to those skilled in the art, when considering the principles set forth herein.

It should now be apparent that the improved frame-supported membrane for chimney as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A frame-supported membrane structure for a chimney column, comprising:

an upright, gas-tight tubular membrane made of thin, corrosion-resistant material, said membrane including a plurality of axially spaced, circumferentially extending corrugations for accommodating axial expansion and contraction of the membrane;

a relatively open skeletal framework that generally coaxially surrounds the membrane throughout most of the height of the membrane;

generally radially extending means mechanically hanging the membrane from the framework at a large plurality of axially and angularly distributed sites, these hanging means including means for accommodating radial expansion of the membrane from a datum disposition and for accommodating contraction thereof back to that datum position, but for restricting further substantial contraction, so as to restrain against any implosive force which may act on said membrane;

basing means provided on said framework in a lower end region of said framework, this basing means being constructed and arranged, when resting on a fixed foundation, to provide substantially all of the necessary vertical support for the framework and membrane;

said basing means comprising:

a girder means extending perimetrically about the framework as a part thereof in the vicinity of the lower extent of the framework;

a base having a plurality of upwardly facing shoulder surfaces provided thereon at angularly spaced sites generally in a common horizontal plane;

a plurality of grillage bars fabricated into a grid having at least a generally central cell and a plurality of bar end portions extending laterally outwards in relation to said central cell;

at least some of said bar end portions being supported upon respective ones of said shoulder surfaces of said base; and said girder means resting on said grid on said generally central cell.

2. The frame-supported membrane of claim 1, wherein:

the framework is made of carbon steel and the membrane is made of a more corrosion-resistant alloy.

3. The frame-supported membrane of claim 2, wherein:

the membrane is made of Inconel Alloy 625.

4. The frame-supported membrane of claim 1, wherein:

the membrane is made of a plurality of circularly arcuate panels butt seamed end-to-end within levels, and circumferentially seamed edge-to-edge from level to level; and further comprising:

a stiffener ring externally reinforcing each such circumferential seam.

5. The frame-supported membrane of claim 1, wherein:

the panel vertical edges are butt welded together, and welded to the stiffener rings; and said mechanically interconnecting means connect the framework with the stiffening rings.

6. The frame-supported membrane of claim 5, wherein:

each panel of said membrane has one such corrugation, and that corrugation extends horizontally across the respective said panel generally midway between the upper and lower edges thereof.

7. The frame-supported membrane of claim 1, wherein:

the membrane further includes an upper end tubular portion mounting a rainhood and a lower end tubular portion having a breeching conduit intersecting generally horizontally therewith.

8. The frame-supported membrane of claim 1, wherein:

said base is constituted by a tubular masonry chimney column stationed on a fixed foundation and rising circumferentially about said framework for a substantial portion of the vertical extent of the framework;

said shoulder surfaces being provided as notch surfaces internally provided within said tubular masonry chimney column near the lower extent of the tubular masonry chimney column.

9. The frame-supported membrane of claim 8, wherein:

said framework normally is radially spacedly circumferentially surrounded by said masonry chimney column throughout the height thereof above said grid to the upper extent of said masonry chimney column.

10. The frame-supported membrane of claim 9, further comprising:

a set of angularly spaced shock-absorbing limited lateral motion-permitting bumpers provided between said masonry chimney column and said framework at at least one elevated level of said frame-supported membrane.

11. The frame-supported membrane of claim 1, wherein:

said relatively open skeletal framework is so externally open as to permit visual inspection of substantially all of the exterior of said membrane from externally of the framework.

* * * * *